US006993862B2

(12) United States Patent
Bedretdinov

(10) Patent No.: US 6,993,862 B2
(45) Date of Patent: Feb. 7, 2006

(54) UNIVERSAL IRONING PRESS

(75) Inventor: Amir Khasianovich Bedretdinov, Geneva (CH)

(73) Assignee: Exeq S.A., Geneva (CH)

( * ) Notice: Subject to any disclaimer, the term of this patent is extended or adjusted under 35 U.S.C. 154(b) by 10 days.

(21) Appl. No.: 10/495,163

(22) PCT Filed: Feb. 12, 2002

(86) PCT No.: PCT/IB02/00405

§ 371 (c)(1),
(2), (4) Date: May 11, 2004

(87) PCT Pub. No.: WO03/069045

PCT Pub. Date: Aug. 21, 2003

(65) Prior Publication Data

US 2005/0011090 A1 Jan. 20, 2005

(51) Int. Cl.
*D06F 71/36* (2006.01)

(52) U.S. Cl. ..... 38/20

(58) Field of Classification Search ..... 38/20, 38/31, 36–41

See application file for complete search history.

(56) References Cited

U.S. PATENT DOCUMENTS

| | | | | | |
|---|---|---|---|---|---|
| 2,337,455 | A | * | 12/1943 | Davis | 91/425 |
| 2,521,708 | A | * | 9/1950 | Foster | 38/25 |
| 3,590,502 | A | * | 7/1971 | Hentschel et al. | 38/28 |
| 4,553,343 | A | * | 11/1985 | Primati et al. | 38/33 |
| 4,922,637 | A | * | 5/1990 | Davidson et al. | 38/15 |
| 5,161,316 | A | * | 11/1992 | Saito | 38/36 |
| 6,088,940 | A | * | 7/2000 | Golay | 38/24 |

FOREIGN PATENT DOCUMENTS

| | | |
|---|---|---|
| FR | 2 772 055 | 6/1999 |
| WO | WO 98/39510 | 9/1998 |

* cited by examiner

*Primary Examiner*—Ismael Izaguirre
(74) *Attorney, Agent, or Firm*—Young & Thompson

(57) ABSTRACT

Automated compact ironing press includes a base on which is articulated a pressing arm bearing a heating plate for co-operating with one of two ironing boards in the base. The press further includes a pressing mechanism driven by an electric motor. The pressing arm has a resilient element connected to the pressing mechanism at one of its end that may be displaced by the electric motor from a position where the vertical component of the pressure force is minimized to a position where the pressure force is maximized. The main ironing board is pivoted on the base thanks to connecting levers and may occupy a retracted position in the base and a service position above the sleeve board, which is rigidly fixed to the base. A water tank and a water pump is cinematically linked to and actuated by the pressing arm.

4 Claims, 8 Drawing Sheets

UNIVERSAL IRONING PRESS

CROSS REFERENCE TO RELATED APPLICATION

This is the 35 USC 371 national stage of international application PCT/IB02/00405 filed on Feb. 12, 2002, which designated the United States of America.

FIELD OF THE INVENTION

The present invention relates to domestic appliances and more particularly to a universal automated ironing press designed to be used mainly at home, in hotels or the like. An object of the invention is to provide a compact automated ironing device easy to use and that does not require physical efforts to achieve high quality ironing.

BACKGROUND OF THE INVENTION

The operation of the ironing press object of the invention is automated and allows a high constant pressure of the heating plate against either a main ironing board or a smaller sleeve ironing board. The exchange of the main ironing board and the sleeve board is done manually and does not require additional adjustment of the press by the user in order to obtain a constant pressure force.

Thanks to the characteristics of the ironing press object of the invention, a higher pressure of the heating plate on the ironing board is achieved, independently of the thickness of the material to be ironed, when compared to existing hand operated similar devices.

Furthermore, prior art devices which comprises two exchangeable ironing boards require complex mechanism to insure that both boards are at the same level during operation.

SUMMARY OF THE INVENTION

The goal of the present invention is to provide a truly automated ironing process with the choice of two different ironing boards and to provide automatic spraying of water on the item to be ironed.

These goals are achieved by providing a compact automated universal ironing press having the characteristics recited in claim 1.

BRIEF DESCRIPTION OF THE DRAWINGS

Other aspects and advantages will become evident from the following detailed description of one embodiment of an ironing press according to the invention made with reference to the accompanying schematic and non limiting drawings in which.

DETAILED DESCRIPTION OF THE INVENTION

Figure 1:
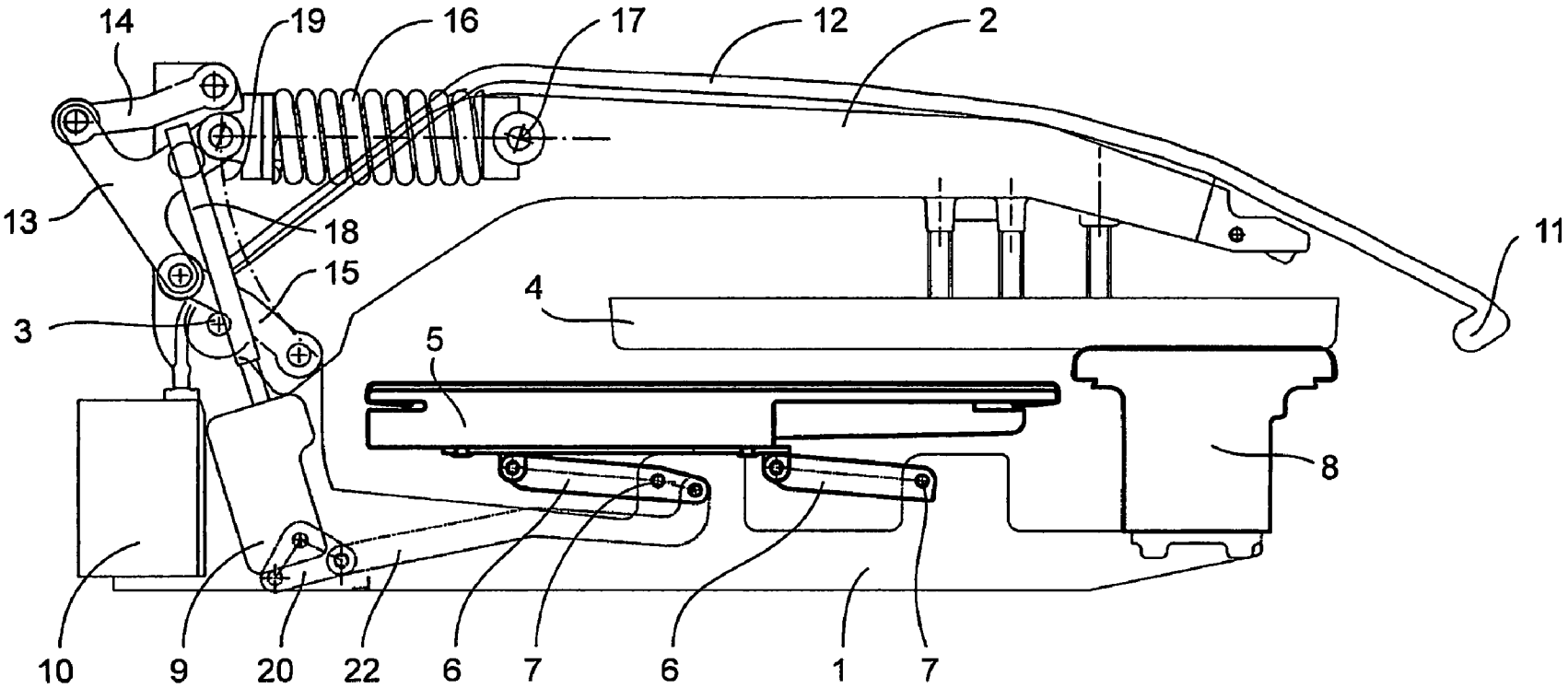
FIG. 1 is a partial cross sectional side view of the ironing press according to the invention in a closed position when the heating plate is pressed against the sleeve board.
Figure 2:
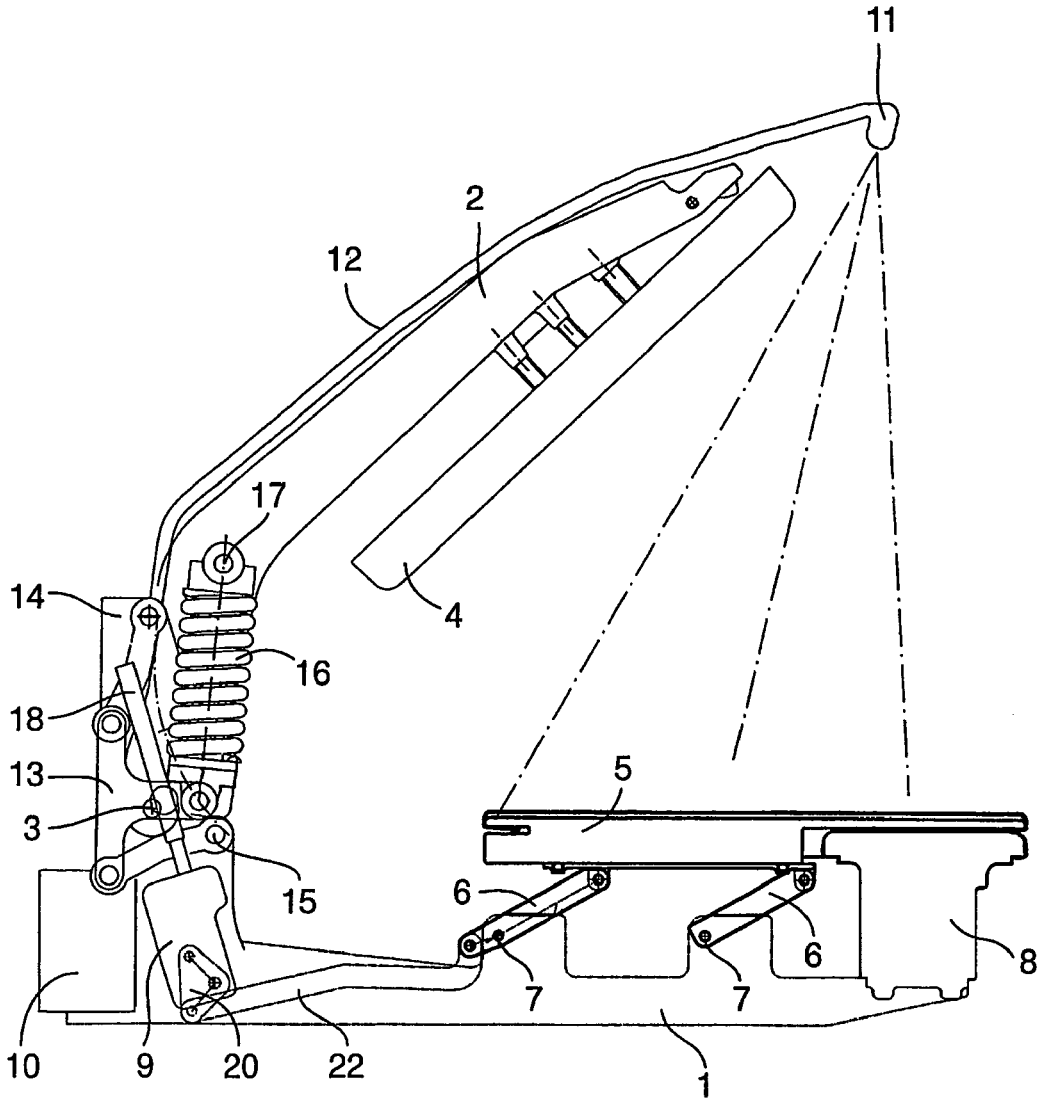
FIG. 2 is a partial cross sectional side view of the ironing press in open position with the main ironing board in service position.

Referring to FIG. 1, the ironing press comprises a case 1 forming the base of the press, on which is articulated a pressing arm 2. The pressing arm 2 is hinged around pivot pin 3 in the base 1 and can be moved from the close position shown at FIG. 1 toward an open position illustrated in FIG. 2. The pressing arm 2 is bearing a heating plate 4 that is brought into contact with the ironing boards during the ironing process. The pressing arm 2 has a first part that is substantially parallel to the heating plate 4 and a second part forming an angle with the first part.

Two ironing boards are installed in the base 1. Firstly, a main large ironing board 5 is linked to the base 1 thanks to levers 6 articulated around axes 7. This main ironing board can be moved between the two positions shown respectively at FIGS. 1 and 2. Secondly, a smaller ironing board 8 is rigidly connected to the base 1. This second ironing board 8 is provided for ironing small pieces of fabrics or for ironing the sleeves of shirts for example. It will further be referenced as the sleeve board 8. In the position shown at FIG. 1, the main board 5 is in a low retracted position whereas at FIG. 2 the main board 5 is in its working position above the fixed sleeve board 8. At FIG. 1, the heating plate 4 is pressed against the sleeve board 8 during operation, whereas at FIG. 2 the heating plate co-operates with the upper surface of the main ironing board 5.

The press further comprises an electric motor 9 that drives a pressing mechanism that will be detailed hereunder.

A water pump 10 comprising a water tank is installed in the base 1 and connected to spraying nozzles 11 via pipes 12. The pump 10 has a cinematic connection with the pressing arm 2 and is activated when the pressing arm 2 is moved between open (FIG. 2) and close position (FIG. 1).

The pressing mechanism comprises a connecting member 13 shaped, in the example illustrated, as a T with a horizontal and a vertical bar. One end of the horizontal bar is connected via a lever 14 to the base 1, the other end of the horizontal bar is connected to the pressing arm via a lever 15. The end of the vertical bar is connected to a resilient member shown as a spring 16. The other extremity of the spring 16 is hinged in the pressing arm 2 around a pivot 17. The central part of the vertical bar of the connecting member 13 is driven by transmission means 18 connected to the electric drive 9. In an alternate embodiment the pressing mechanism may be actuated manually thanks to a lever. In the open position shown at FIG. 2, the spring 16 is almost parallel to the inclined part of the pressing arm 2. At FIG. 1, the electric drive has been activated and the connecting member 13 has been moved upwardly along the shaft 18 thus displacing the extremity of the spring 16 along a dotted line 19. In this working position, the spring 16 is almost parallel to the horizontal part of the pressing arm 2 bearing the heating plate 4.

When the spring is in the position illustrated at FIG. 1, the vertical component of the force urging the pressing arm 2 against one of the ironing board 5,8 is minimised. When the connecting member 13 is moved down under the action the transmission means driven by the electric motor 9, the vertical component of the force is maximised and an optimal pressure of the heating plate 4 against the ironing board is achieved without excessive efforts required from the user.

Figure 3:
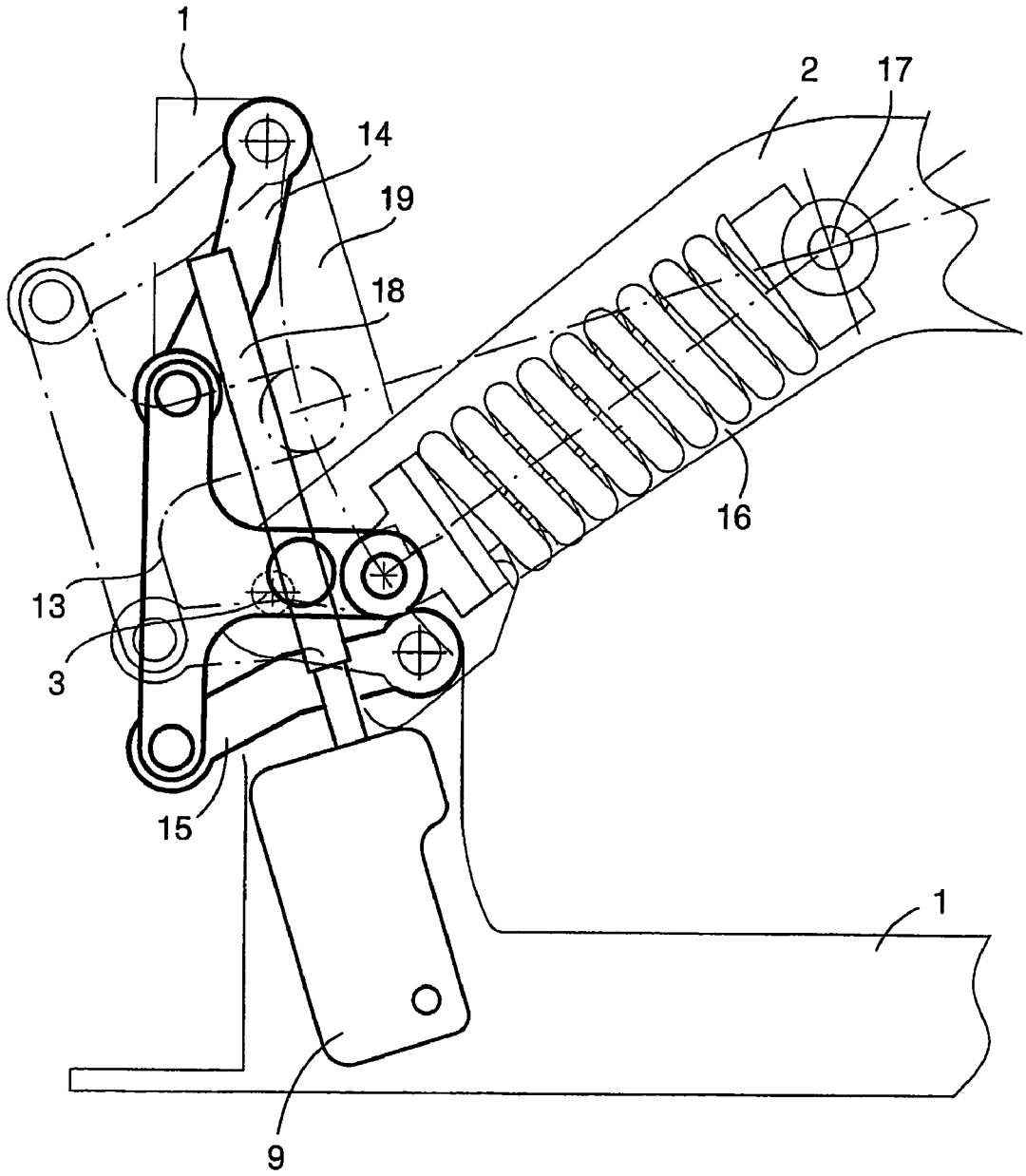
FIG. 3 is a cross sectional side view illustrating the details of the pressing mechanism in two different positions.

FIG. 3 shows a detailed enlarged view of the elements forming the pressing mechanism in two different positions. As one can see, the orientation of the spring 16 is modified when the connecting member is moved upwardly or downward under the action of the motor 9. When the connecting member 13 is in its upper position, the spring is almost parallel to the heating plate 4. In that position, the vertical component of the force is almost null which facilitates the manual opening/closing of the pressing arm 2. When the connecting member 13 is in its lowest position, the axis 3 of rotation of the pressing arm 2 is almost in the same plane as the extremity of the resilient member 16. This pressing mechanism serves two purposes, the first one is to provide an adequate pressing force of the heating plate 4 against one of the two ironing board, when the connecting member 13 is in its lower position. The second function of the pressing mechanism is to facilitate the opening/closing of the pressing arm 2. When the connecting member 3 is in upper position, the resilient element 16 is almost parallel to the heating plate 4 and therefore pressure applied downwardly on one of the ironing board 5,8 is minimised.

Naturally, the shape of the connecting member 13 may differ in alternate embodiments. If necessary, the may be more or less levers for linking the connecting member 13 to the base 1. This design has been adopted as it provides a compact press having no extending parts during opening/closing of the pressure arm 2, but obviously the may be alternate designs that fulfil the same functions. It is also possible to have several pressing mechanism in parallel if necessary.

Figure 4:
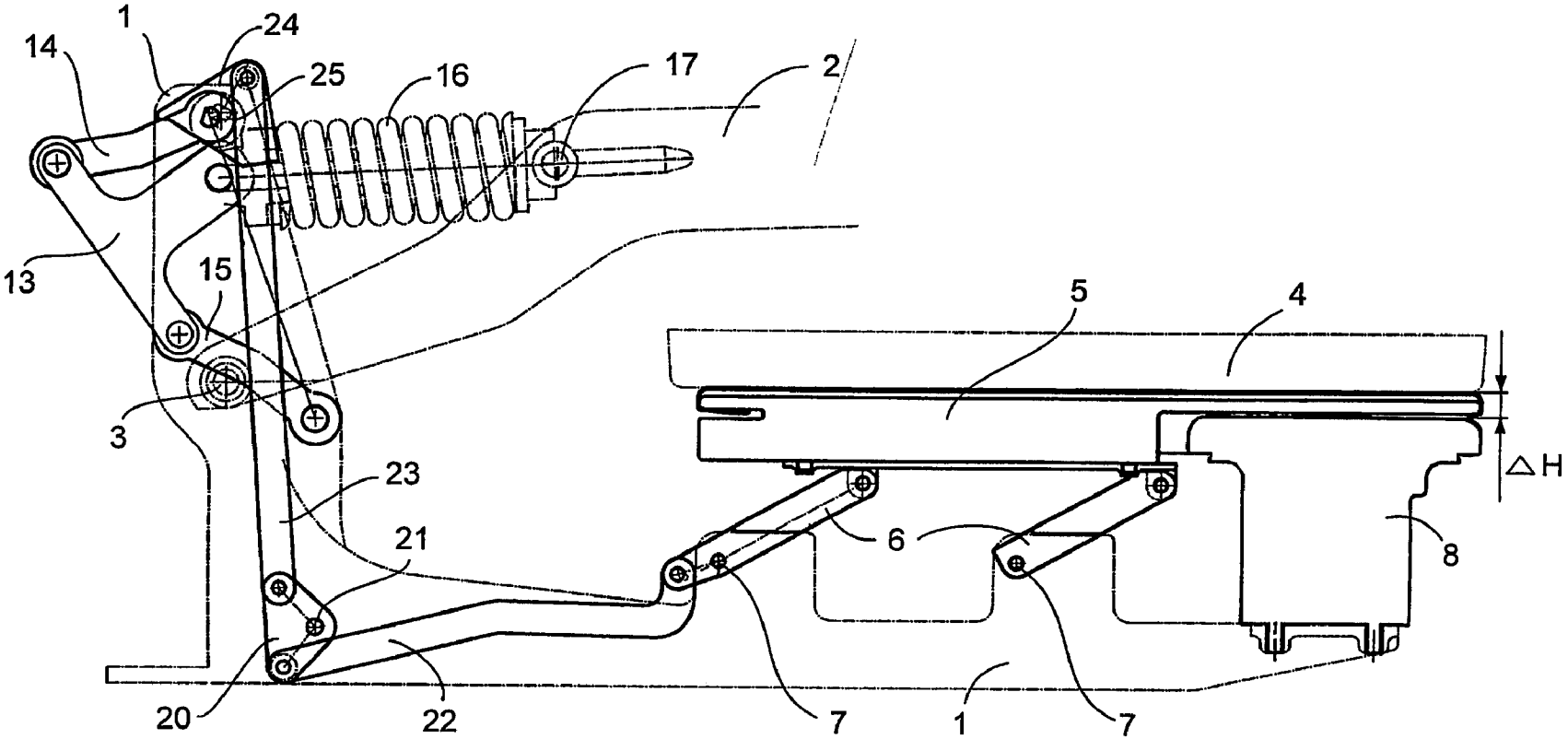
FIG. 4 is a side view of the ironing press with the main ironing board in service position.
Figure 5:
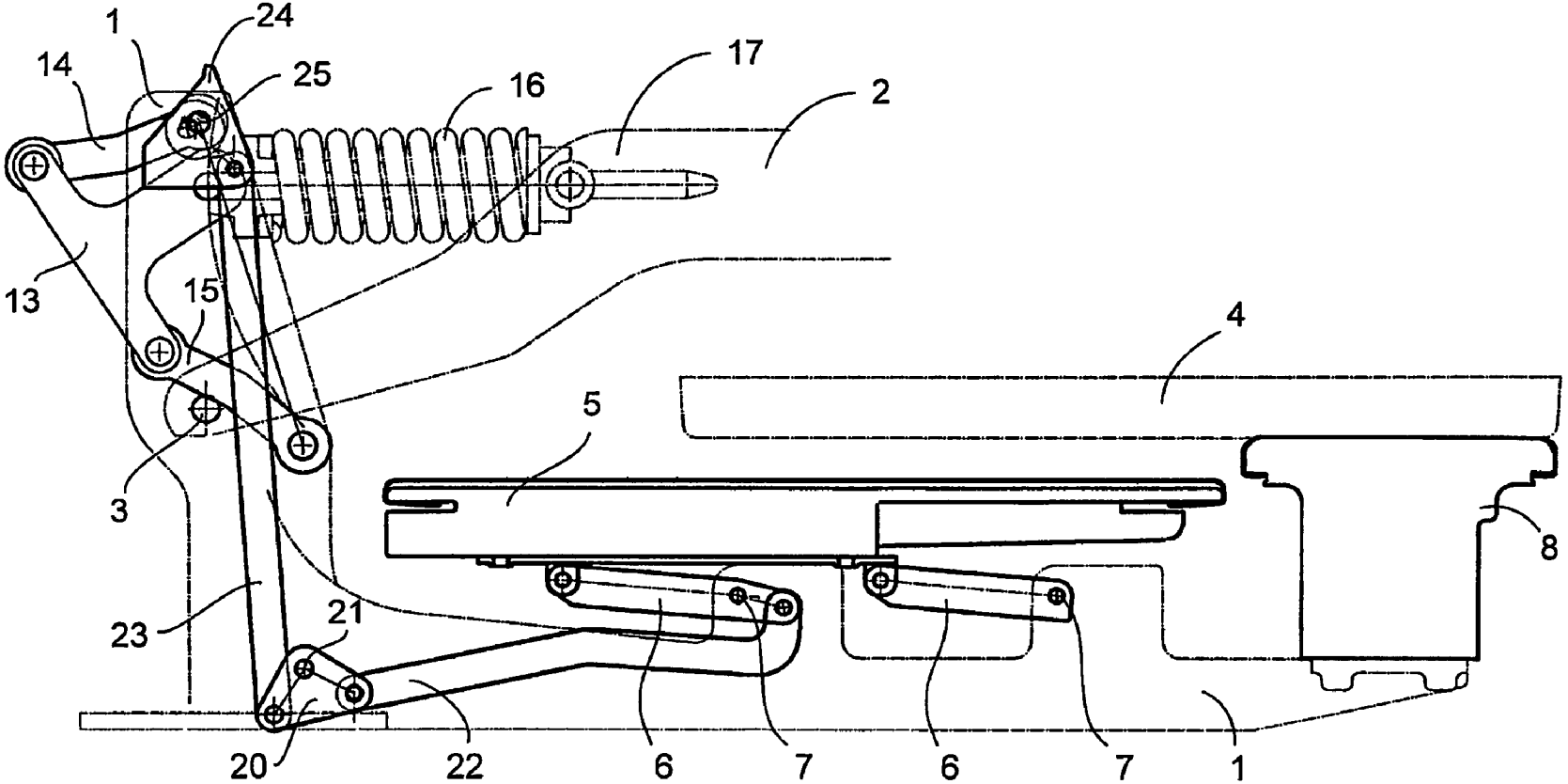
FIG. 5 is a view similar to FIG. 4 with the main ironing board in retracted position.

FIGS. 4 and 5 show respectively the main ironing board 5 in service position and in a retracted or resting position. The main ironing board 5 is in service position, above the sleeve board 8, at FIG. 4. The board 5 is hinged on the base 1 thanks to levers 6 and can rotate around axis 7. At least one of the two levers 6 is connected to an eccentric element 20 pivoted on the base 1 around axis 21 by a connecting lever 22. The eccentric element 20 is further connected via a vertical connecting member 23 to a second eccentric 24 pivoted in the upper part of the base 1 around axis 25. The eccentric 24 modifies, when rotating, the vertical position of the lever 14 linking the T element 13 to the upper part of the base 1. The lever 14 is connected to the base 1 and can move freely for example in a vertical slit located in the base. Therefore the end of the lever 14 can occupy, depending of the position of the eccentric elements, different vertical positions. When the main ironing board 5 is in service position, as illustrated at FIG. 4, the lever 14 is in its upper position and when the main ironing board 5 is retracted, as shown at FIG. 5, the lever 14 lies in its lower position. Thanks to this mechanism, one can compensate the level difference $\Delta H$ between the upper surface of the main ironing board and the upper surface of the sleeve board 8 (see FIG. 2). This allows a constant pressure force to be applied by the pressing element 2,4 independently of the ironing board 5,8 used. As the main board 5 is above the sleeve board in operation, the connection point between the base 1 and the pressing mechanism 14,13 is located in the upper position. When retracting the main board 5 (FIG. 5), in order to use the sleeve board 8 in connection with the heating plate 4, the above mentioned connection point is moved down in order to compensate the vertical difference of level between the two boards 5,8.

When the main ironing board 5 is retracted as shown at FIG. 5, the vertical position of the lever 14 is lowered thanks to the cinematic connection between the main board and the pressing mechanism. Therefore, the user has no manual adjustment to operate if he decides to exchange the working ironing board. The simple movement applied to the main board automatically compensates for the difference of level between the two ironing boards.

Figure 6:
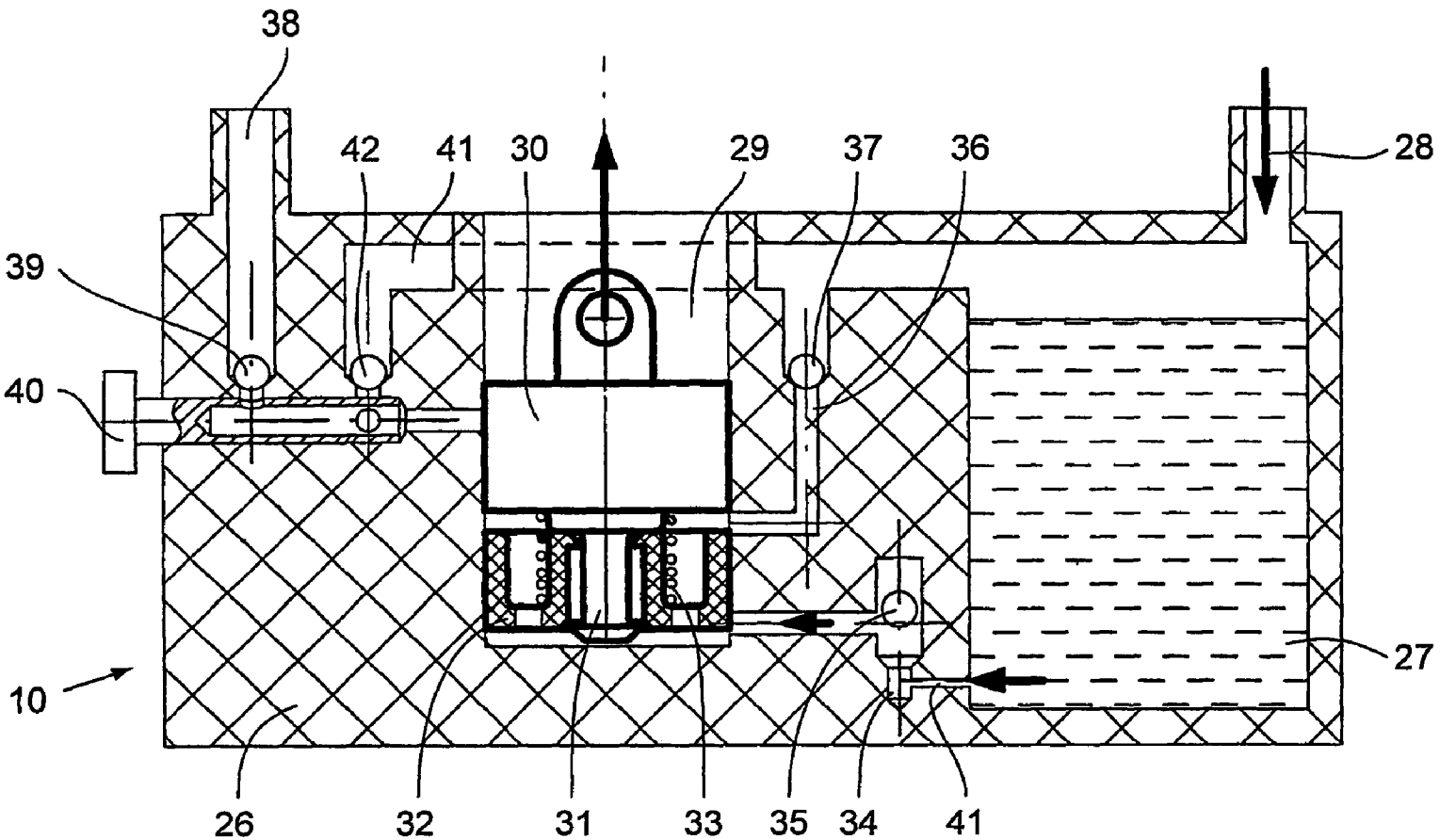
FIG. 6 is cross sectional view of the water pump system, the plunger being in lower position.

The water spraying system will now be described with reference to FIGS. 6, 7 and 8. The pump 10 which is connected to the spraying nozzles 11 through connecting pipes 12 is illustrated at FIG. 6. The pump 10 is made of a casing 26 which comprises a water tank 27 that may be filled up with water by the inlet 28. The pump further comprises a hollow cylinder 29 in which a plunger element may be vertically displaced. The plunger element includes a main plunger 30 that is cinematically connected to a lever (not shown) driven by the pressing arm 2. A shaft 31 is rigidly connected to the lower part of the main plunger 30. A cover plunger 32 may slide freely around the shaft 31 against the action of a resilient means, represented as a spring 33. The pump further comprises an admission pipe 34 comprising a valve element 35. This admission pipe connects the bottom of water tank 27 to the bottom of the cylinder 29. An escape pipe 36 with a valve element 37 connects the upper part of the water tank with the middle of the cylinder 29. An outlet pipe 38 comprising a valve element 39 is connected to the upper part of the cylinder 29 via a regulator organ 40. The outlet pipe 38 is further connected to the connecting tubes 12 feeding the spraying nozzles 11 installed at the extremity of the pressing arm 2.

When the pressing arm 2 is pushed down to close the ironing press, it drives the main plunger 30 down in the bottom of the cylinder 29. The plungers 30 and 32 are located in the bottom of the cylinder 29, the spring 33 being contracted as shown at FIG. 6. When the pressing arm, driving the plunger 30 thanks to its cinematic connection, is moved up, the motion of the plunger 30 in the cylinder induces a depression and the water may flow from the water tank 27 through the admission pipe 34 into the cylinder 29. When the water flows through a calibrated hole 41, hydraulic resistance is overcome and as a result, the force to be applied to the pressing arm to open the press decreases while the plunger moves up. In this mode the pump functions as an absorber.

Figure 7:
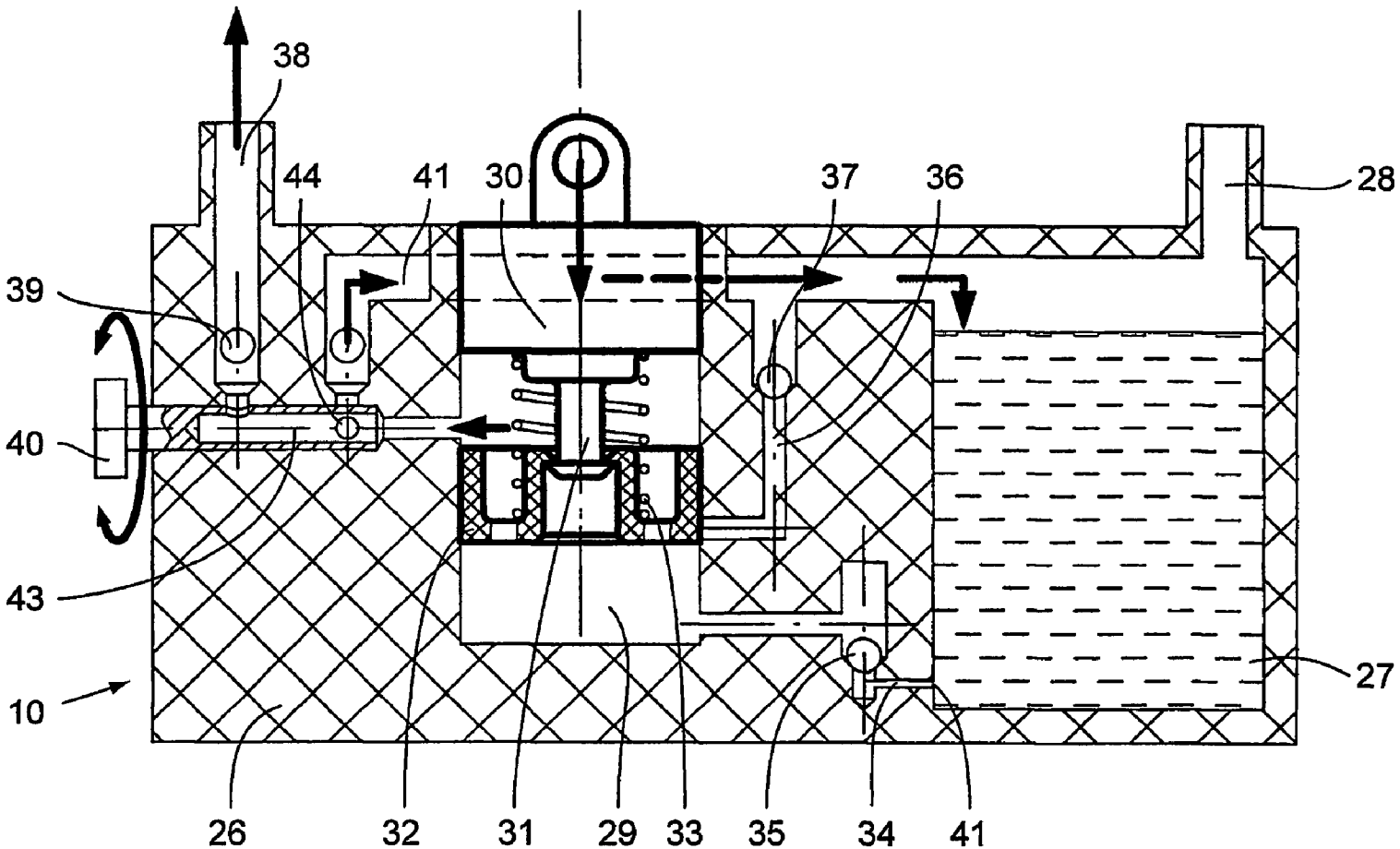
FIG. 7 is a similar view of FIG. 6, with the plunger in upper position.

When the pressing arm is fully open, the plungers occupy the position illustrated at FIG. 7. In this position, the escape channel 36 is closed by the cover plunger 33. The regulator 40 has a rotating shaft 43 with two holes 44. When the regulator is turned from a certain angle, it connects the cylinder 29 either with the outlet channel 38 or with a discharge channel 41 connected to the water tank 27. This way, it is possible to decrease or stop the water supply to the outlet channel connected to the spraying nozzles.

The escape channel 41 and the outlet channel are arranged with a valve element 39 that provides a unidirectional flow of the water, avoiding this way any entry of air in the cylinder cavity and holds water in the connecting tubes 12.

Figure 8:
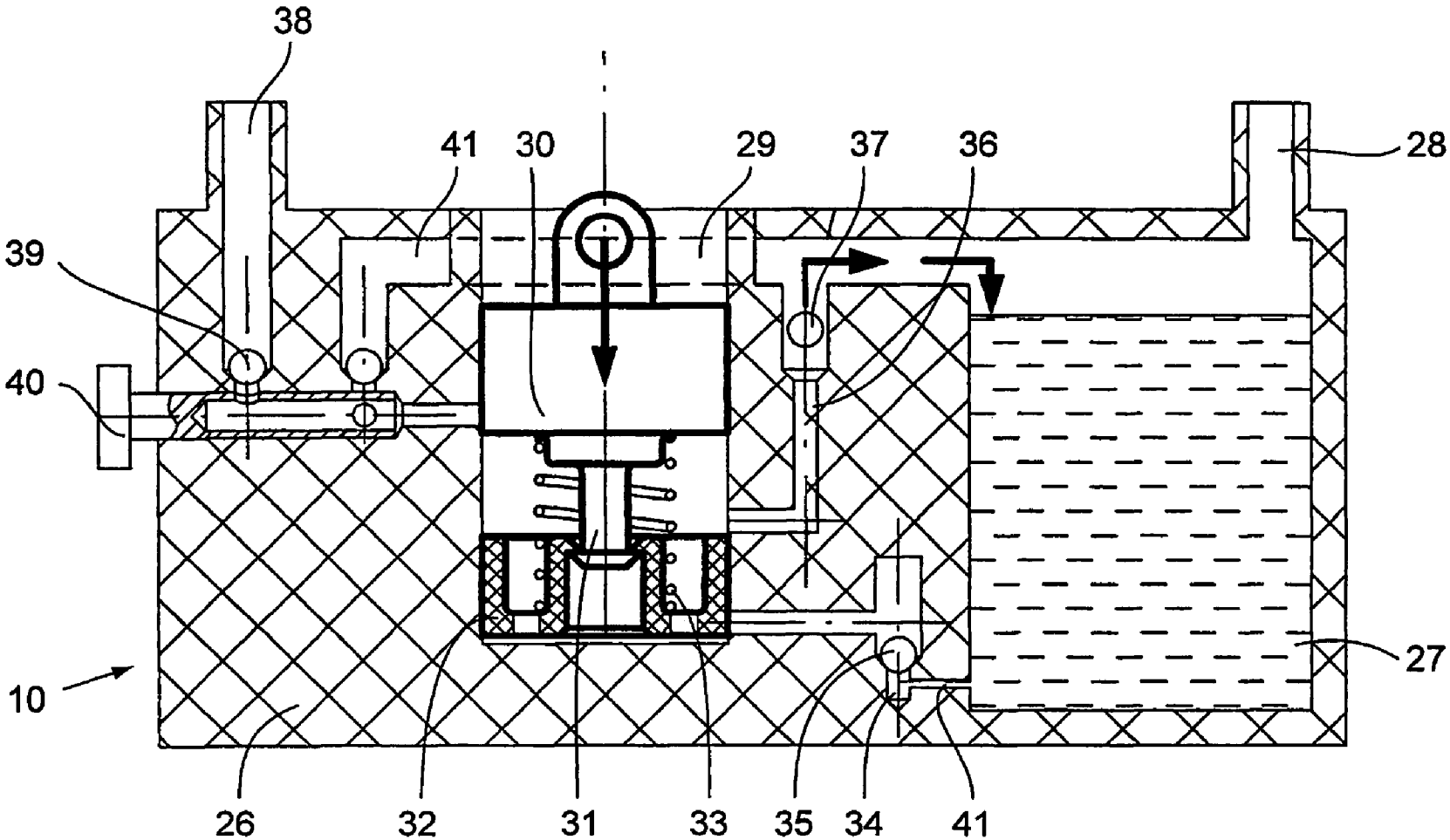
FIG. 8 is a view of the water pump mechanism illustrated at FIGS. 6 and 7 with the plunger element in an intermediate position.

When the pressing arm is moved down by a certain angle, the plungers 30,32 occupy the position shown at FIG. 8. In this position, the main plunger 30 closes the outlet channel. With a further movement of the pressing arm 2, the water is forced in the escape channel 36, passes the valve element 37 and goes back to the water tank 27. During this movement, the water is not supplied to the spraying nozzles since the outlet channel 38 remains closed by the main plunger 30. At the end of the cycle, the plungers are in the position shown at FIG. 6.

The use of the press may be summarised as follow. A cloth or garment is put on one the selected ironing board, either the main board 5 or the sleeve board 8, depending on the type of clothe. Then the pressing arm 2 is moved down and and thanks to its cinematic connection with the plungers 30,32 of the pump 10, water is sprayed on the surface of the cloth. When the pressing arm has reached a certain rotation angle, water supply to the spraying nozzles stops as explained above. Once the pressing arm is applied against the ironing board 5 or 8, the operator press the switch on button of the electronic control bloc (not shown) and the electric motor activates the pressing mechanism so as to urge the heating plate 4 against the ironing board. Once the ironing process is terminated, the pressing mechanism is automatically released and the operator may open the pressing arm 2 without effort.

The universal automatic ironing press according to the invention has the following advantages:

It allows the quality ironing of many types of garments with a constant pressure independently of the ironing board used. It further has compact design and is also simple, comfortable and economic to manufacture;

Of course the embodiment described above are in no way limiting and may be the subject of any desirable modification within the scope defined by the following claims. Specifically the pressing mechanism may have mechanical equivalent leading to the same function, i.e. minimising and maximising the vertical component of the force applied to the ironing boards, without departing from the scope of present invention as defined in the following claims.

What is claimed is:

1. Automated ironing press comprising:

a pressing arm articulated on a base around an axis;

the pressing arm including a heating plate for ironing fabrics or garments on at least one ironing board comprised of a main board and a sleeve board;

the sleeve board being rigidly fixed to the base, and the main board being articulated on the base via levers pivoted on the base;

the main board structured and arranged to occupy a retracted position in the base, and a working position where the lower surface of the main board is in contact with the upper surface of the sleeve board;

said press further comprising an electric motor and a water pump connected to spraying nozzles through pipes;

the pressing arm comprising a resilient element rigidly fixed at one of its end to the pressing arm and at its other end to at least one connecting member;

the connecting member being movable under the action of the electric motor and transmission means from a resting position in which the resilient element is substantially parallel to the pressing arm bearing the heating plate, to a second position where the end of the resilient element linked to the connecting member substantially coincides with the rotation axis of the pressing element on the base.

2. The ironing press according to claim 1, wherein the connecting member is T shaped, each end of the horizontal bar of the connecting member being connected to the base via connecting levers, and the end of the vertical part of the T shaped connecting member being connected to one end of the resilient element, while the transmission means are fixed substantially in the center of the vertical bar of the connecting member.

3. The ironing press according to claim 1, wherein the main board is linked to a pressing mechanism through a cinematic chain, which actuates an eccentric that changes the vertical position of the pressing mechanism.

4. The ironing press according to claim 1, wherein the water pump is cinematically linked to and actuated by the pressing arm.

* * * * *